US005703441A

United States Patent [19]

Steigerwald et al.

[11] Patent Number: 5,703,441

[45] Date of Patent: Dec. 30, 1997

[54] MULTI-FUNCTION FILAMENT-HEATER POWER SUPPLY FOR AN ELECTRONIC BALLAST FOR LONG-LIFE DIMMERABLE LAMPS

[75] Inventors: Robert Louis Steigerwald, Burnt Hills; Chester Frank Saj, Amsterdam; Ljubisa Dragoljub Stevanovic, Clifton Park, all of N.Y.

[73] Assignee: General Electric Company, Schenectady, N.Y.

[21] Appl. No.: 551,968

[22] Filed: Nov. 2, 1995

[51] Int. Cl.[6] ..... G05F 1/00

[52] U.S. Cl. ..... 315/307; 315/308; 315/209 R; 315/94; 315/DIG. 4

[58] Field of Search ..... 315/94, 96, 98, 315/209 R, 194, 219, 306, 307, 308, DIG. 4, DIG. 7

[56] References Cited

U.S. PATENT DOCUMENTS

| | | | |
|---|---|---|---|
| 4,523,131 | 6/1985 | Zansky | 315/307 |
| 4,682,080 | 7/1987 | Ogawa et al. | 315/209 R |
| 4,866,350 | 9/1989 | Counts | 315/209 R |
| 4,870,327 | 9/1989 | Jorgensen | 315/307 |
| 4,873,471 | 10/1989 | Dean et al. | 315/308 |
| 5,432,406 | 7/1995 | Brooks | 315/94 |

FOREIGN PATENT DOCUMENTS

| | | |
|---|---|---|
| 0650313A | 10/1994 | European Pat. Off. . |
| 707438A2 | 10/1995 | European Pat. Off. . |

*Primary Examiner*—Robert Pascal
*Assistant Examiner*—Haissa Philogene
*Attorney, Agent, or Firm*—Jill M. Breedlove; Marvin Snyder

[57] ABSTRACT

A filament-heater power supply includes a combination forward and flyback power converter for supplying electronically variable, isolated voltages to dimmable discharge lamp filaments while supplying a fixed dc output voltage to a ballast control circuit. Hence, only a single ballast power supply is needed. The control circuit controls the level of filament voltage to operate the lamp filaments at an optimum temperature, even during dimming operation, thereby substantially extending lamp life. The filament-heater power supply provides a high degree of isolation among filament voltages while regulating and tracking the voltage across each filament. The filament-heater power supply can preheat the filaments to aid lamp starting, thereby extending the useful life of the lamp, and is also structured to sense when a lamp is not present in a fixture so that high voltage starting pulses are not applied to the terminals of an empty fixture.

9 Claims, 4 Drawing Sheets

18b

MULTI-FUNCTION FILAMENT-HEATER POWER SUPPLY FOR AN ELECTRONIC BALLAST FOR LONG-LIFE DIMMERABLE LAMPS

FIELD OF THE INVENTION

The present invention relates generally to power supplies and, more particularly, to power supplies for electronic ballasts for dimmable lamps.

BACKGROUND OF THE INVENTION

Power to filaments in a discharge lamp, such as a fluorescent lamp, is usually supplied by connecting the filaments in series with a capacitor, the series circuit then being connected in parallel with the lamp. Unfortunately, it is generally accepted that the life of dimmable discharge lamps is reduced by the dimming function because conventional ballasts do not optimize the filament voltage at which dimmable lamps operate. Furthermore, as an additional disadvantage, the control power for dimmable lamps is typically supplied from an additional power supply that is separate from the power supply for the ballast inverter.

Accordingly, it is desirable to provide a power supply for an electronic ballast for a dimmable lamp which provides electronically variable, electrically isolated voltages to lamp filaments, which power supply also provides a fixed voltage to the ballast inverter control circuitry. Further, it is desirable that such a power supply maintain the filaments at an optimum operating temperature, even during dimming operation. Still further, it is desirable that such a power supply have the capability for sensing when a lamp is not present in a fixture so that high voltage starting pulses are not applied to the terminals of an empty fixture.

SUMMARY OF THE INVENTION

A filament-heater power supply comprises a combination forward and flyback power converter for supplying electronically variable, electrically isolated voltages to dimmable lamp filaments while supplying a fixed dc output voltage to a ballast control circuit. Advantageously, therefore, only a single ballast power supply is needed. (Alternatively, however, if desired, each lamp in a multi-lamp system can be driven by a separate filament-heater converter.) The control circuit controls the level of filament voltage to operate the lamp filaments at an optimum temperature, even during dimming operation, thereby substantially extending lamp life. The filament-heater power supply provides a high degree of isolation among filament voltages while regulating and tracking the voltage across each filament. Preferably, the filament-heater power supply preheats the filaments to aid lamp starting, thereby extending the useful life of the lamp. The filament-heater power supply is furthermore structured to sense when a lamp is not present in a fixture or has non-operational filaments so that high voltage starting pulses are not applied to the terminals thereof.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
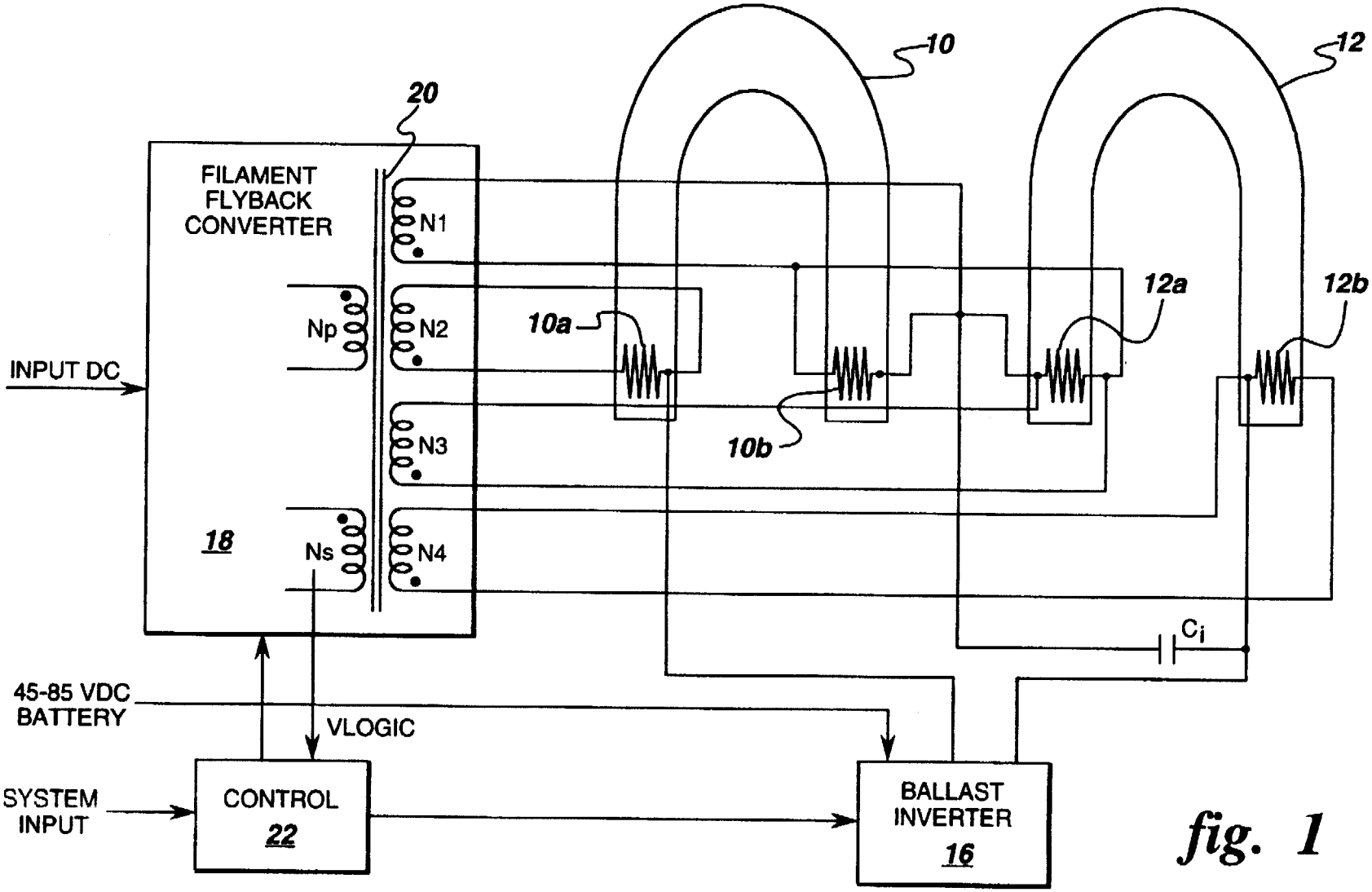
FIG. 1 illustrates a ballast system for dimmable discharge lamps in accordance with the present invention.

FIG. 1 illustrates a ballast system in accordance with the present invention. By way of example only, the ballast system of FIG. 1 is shown as supplying two fluorescent lamps 10 and 12 connected in series, each lamp having two lamp filaments 10*a*–10*b* and 12*a*–12*b*, respectively. One lamp is connected in parallel with a starting capacitor Ci which momentarily shorts lamp 12 so that more voltage is applied to lamp 10 for starting. Power is supplied to the two lamps 10 and 12 through a ballast inverter 16 which may be of any well-known type suitable for driving series-connected lamps having negative resistance characteristics. A filament-heater power supply 18 converts an input dc voltage (e.g., 5 V) to provide isolated voltages through a transformer 20 having a primary winding Np and secondary windings N2, N1, N3 and N4, respectively, to the four lamp filaments 10*a*, 10*b*, 12*a*, and 12*b*, respectively. The filament-heater power supply 18 has an additional winding Ns for providing power, after rectification, to a control logic circuit 22 which controls both the filament-heater power supply 18 and the ballast inverter 16.

Figure 2:
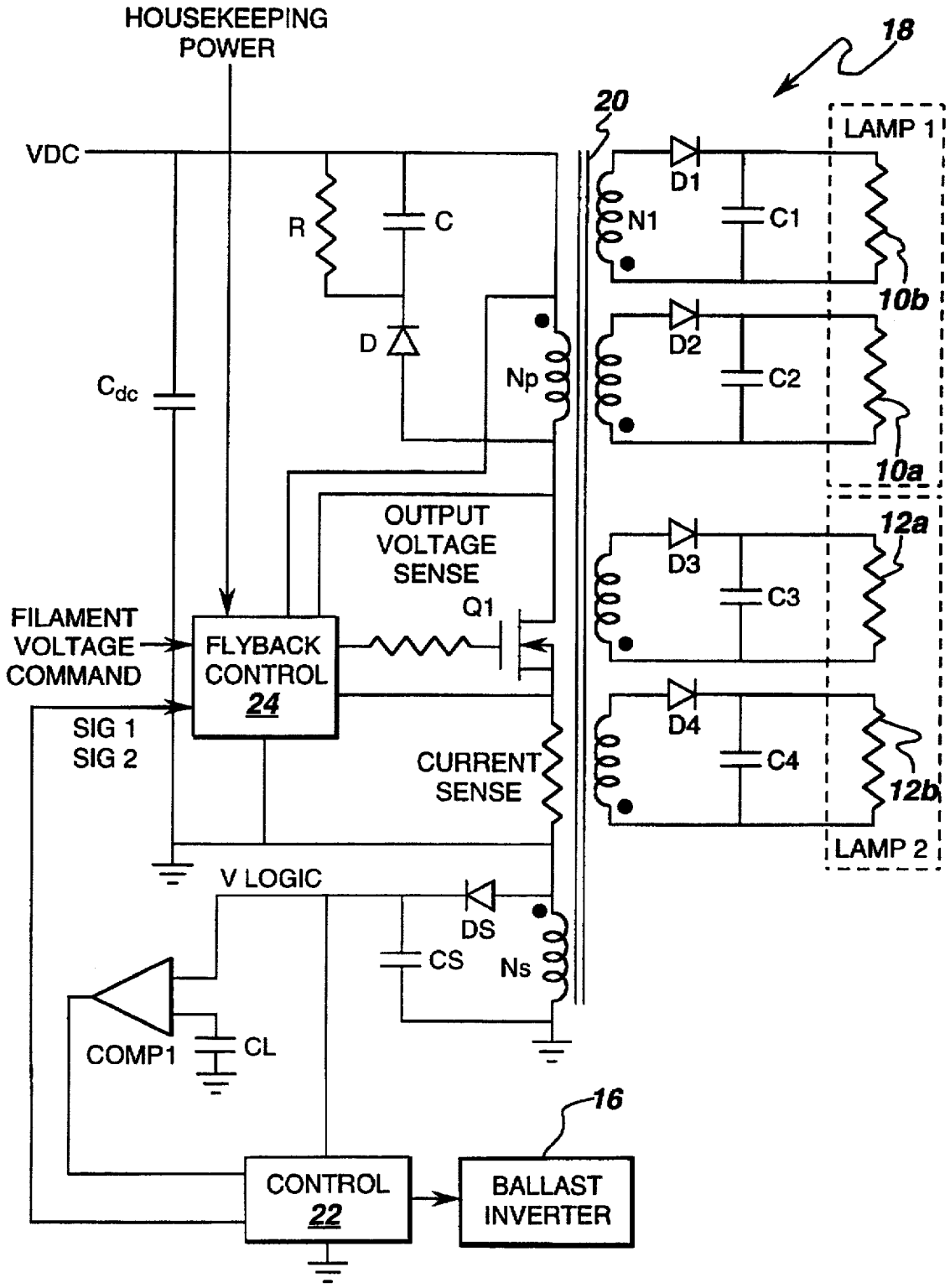
FIG. 2 schematically illustrates one embodiment of the filament-heater power supply of FIG. 1.

FIG. 2 illustrates a filament-heater power supply 18 according to the present invention comprising a combination forward and flyback converter. The forward/flyback converter 18 comprises a main switching device Q1 which is controlled by a flyback control circuit 24 which provides gating signals to device Q1 as commanded by the control logic circuit 22. The four windings N1–N4 with their associated diodes D1–D4 and filter capacitors C1–C4 act in a flyback mode; that is, energy is stored in the core of the transformer 20 when Q1 is on and is transferred to the output when Q1 is turned off. The lamp filament voltage level is controlled by the duty cycle of Q1 which, in turn, is controlled by a filament voltage command that is provided as an input to the flyback control circuit 24. Feedback of the filament output voltages is achieved by sensing the voltage across the transformer primary winding Np when Q1 is off. Because all the transformer windings are closely coupled, the voltage across Np when no current is flowing in the primary winding Np is directly proportional to the filament output voltages, which also track each other due to tight magnetic coupling. In this manner, feedback of the filament voltages is achieved while maintaining galvanic isolation among all the windings.

Power for supplying the control logic circuit 22 is obtained from the same converter 18 by using an additional winding Ns which is connected to have a forward polarity on the same core of transformer 20 as windings N1–N4. When Q1 is on, the input voltage Vdc is transformer-coupled directly to the logic bus (vlogic) through winding Ns and a diode Ds connected in series therewith. As a result, the output logic voltage vlogic is regulated to approximately the same extent as the input bus Vdc is regulated. Hence, if the input bus Vdc is regulated, i.e., is obtained from other system-regulated busses, then the voltage vlogic is directly usable by the ballast control circuits.

Advantageously, a high degree of isolation is maintained among the filament voltages while at the same time controlling, regulating, and tracking them. This is needed because, as a lamp is dimmed, i.e., lamp current decreases, there is less self-heating of the filaments and the flyback converter increases filament voltage in response to a control signal from control 22 to maintain optimum filament temperature. And, since the filaments are at opposite ends of the lamps, there can be substantial voltage between them, e.g., several hundred volts during starting. Voltages can approach 1000 volts peak across the two series-connected lamps at low temperatures, e.g., −25° C., during starting, rendering necessary a high degree of voltage isolation among filaments.

In order to avoid application of high voltage starting pulses to the terminals of an empty fixture (not shown), the present invention advantageously provides for sensing when a lamp is not present in the fixture. In particular, to sense when a lamp is not in a fixture, the level of the vlogic bus is sensed. With no filaments as loads, the duty cycle of the flyback control decreases to a small value in response to the filament voltage feedback signal, i.e., the sensed primary voltage when Q1 is off. As a result, the voltage provided across winding Ns (connected in the forward polarity, as indicated by the dot convention) decreases. This decrease in voltage is sensed by a comparator C1 which, in turn, commands the control circuit 22 to turn off and thereby generate no lamp starting pulses. When lamps are present in the fixtures, power is once again supplied to the filaments, and vlogic returns to its normal value and the control is allowed to start the lamps.

Preferably, the filaments are preheated prior to starting the lamps, i.e., turning on the ballast inverter 16, in order to avoid damaging the filaments when striking the arcs. To this end, the control circuit 22 provides a sufficient time delay (e.g., 0.5–2.5 seconds) between starting the filament-heating converter 18 and the ballast inverter 16.

Figure 3A:
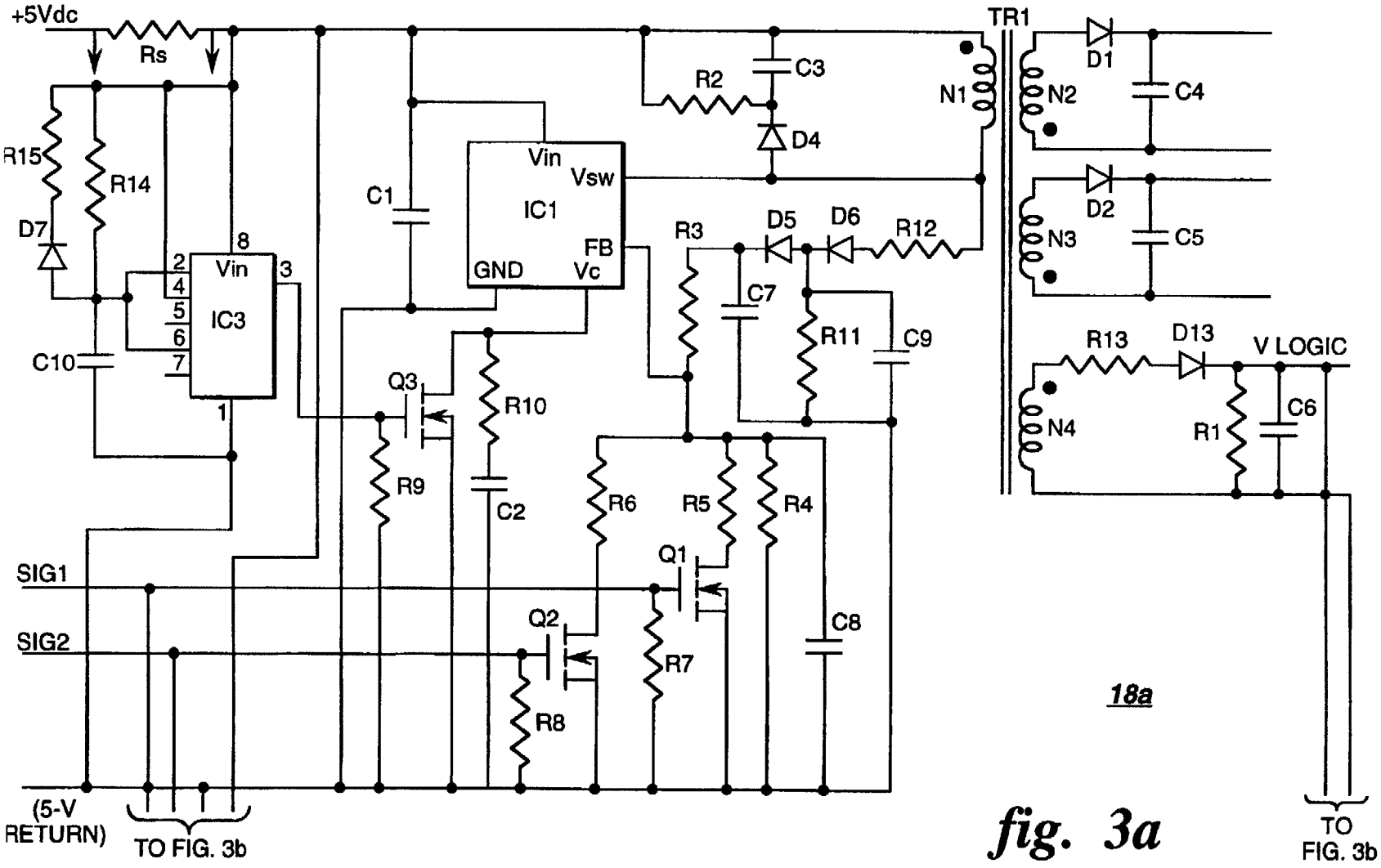
FIGS. 3*a* and 3*b* schematically illustrate an alternative embodiment of the present invention wherein each lamp in a dual-lamp system is driven by a separate filament-heater power supply.
Figure 3B:
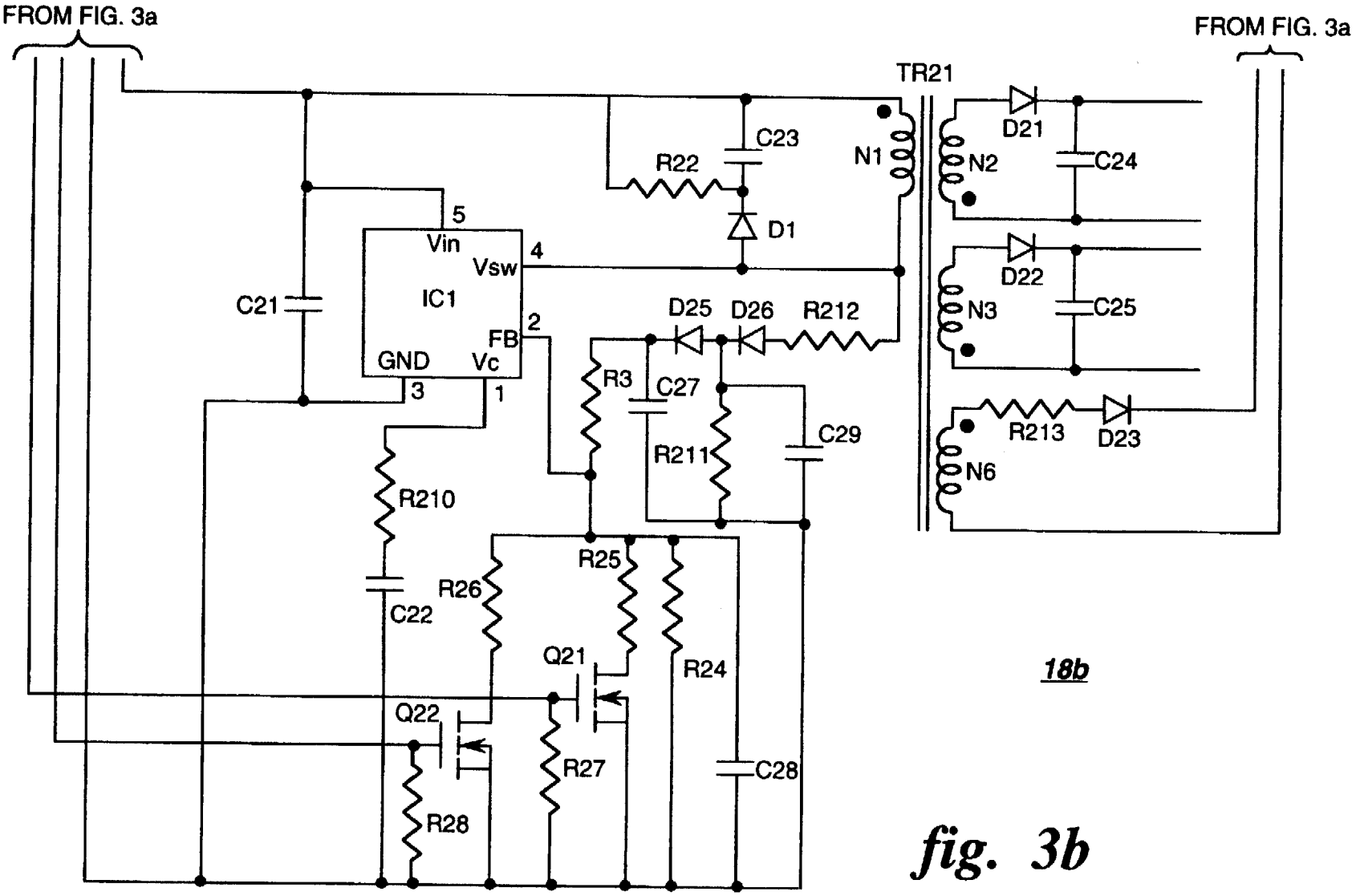

FIGS. 3*a* and 3*b* illustrate an alternative embodiment of the present invention wherein each lamp is driven by a separate filament-heater power supply 18*a* and 18*b*. As shown, suitable commercial integrated circuits IC1 and IC2, such as, for example, of a type LT1170 manufactured by Linear Technology Corporation, may be used. In the embodiment of FIGS. 3*a* and 3*b*, the outputs of the two vlogic supplies are diode-ORed through diodes D13 and D23 so that if one of the filament-heater power supplies fails, then the control logic circuit 22 (FIG. 2) still receives power. In addition, when the circuit of FIGS. 3*a* and 3*b* is turned on, the two supplies 18*a* and 18*b* are started such that the filaments for one lamp are excited and allowed to reach temperature before the filaments for the other lamp are excited. To this end, a timer integrated circuit IC3 prevents the upper circuit 18*a* from starting until a predetermined time has elapsed. Advantageously, therefore, the transient current from the five-volt input supply Vdc is approximately half the value which would otherwise be needed if cold filaments (with their low resistance) for two lamps were excited simultaneously.

As an alternative, instead of providing the diode-OR output configuration, each output filament voltage can be sensed in the manner described hereinabove such that if only one lamp is absent or has non-operational filaments, then the control circuit will not provide a starting signal to the lamps.

In the system of FIGS. 3*a* and 3*b*, the input voltage Vdc is a regulated five volts dc. The voltage at the transformer winding N1 of the lower circuit 18*b* is measured and regulated to regulate the output filament voltages. The sum of the input voltage Vdc and the N1 winding voltage is regulated; and, since the input voltage Vdc is regulated, the result is that the output filament voltages are also regulated. The upper circuit 18*a* regulates its filament voltages in the same manner. By way of example, FIG. 3 illustrates a control with three levels of output filament voltage (e.g., 2.5 V at maximum lamp power, 3.6 V at moderate dimming, and 4 V at minimum lamp power). The desired filament voltage level in each respective lamp is set by switching on or off transistors Q1 or Q2, or Q21 or Q22, respectively, in order to effectively change the voltage divider ratio of the voltage being fed back from the corresponding primary winding N1. Alternatively, instead of providing a discrete number of filament voltage levels, a continuous control could be provided.

The truth table for the exemplary circuit of FIG. 3 is given as follows:

| | | | | | | | | |
|---|---|---|---|---|---|---|---|---|
| | [s] | [H] | | [H] | | [L] | | [L ] |
| sig1 | H | | H | | L | | L | |
| | [s] | [H] | | [L] | | [H] | | [L] |
| sig2 | H | | L | | H | | L | |
| | [o] | [4] | | [3] | | [N] | | |
| OUTPUT | 4 V | | 3.6 V | | NA | | | 2.5 V |

As an alternative, in either the single filament-heater supply system (FIG. 2) or the dual filament-heater supply system (FIG. 3), the actual current being provided by the input dc supply can be sensed (e.g., by a sensor Rs as illustrated in FIG. 3) in order to determine whether operational filaments are present. If, for example, in a two-lamp system, the current is one-half the value for two operational lamps, then one lamp is not present or does not have operational filaments, and the control logic will prevent a starting signal from being provided to that lamp. As another alternative to using sensor Rs to sense the input current, a separate sensor (not shown) could be employed to sense the current to each separate filament in order to determine whether the filaments are operational.

While the preferred embodiments of the present invention have been shown and described herein, it will be obvious that such embodiments are provided by way of example only. For example, although a two-lamp system has been described and illustrated, the principles of the present invention apply to any number of lamps, including a single-lamp system. Numerous variations, changes and substitutions will occur to those of skill in the art without departing from the invention herein. Accordingly, it is intended that the invention be limited only by the spirit and scope of the appended claims.

What is claimed is:

1. A ballast system for at least one dimmable lamp having at least two filaments, comprising:

a ballast inverter for driving said lamp filaments to provide light output;

at least one filament-heater power supply coupled through a transformer to said filaments for providing isolated voltages thereto; and a control circuit coupled to said filament-heater power supply through an additional winding on said transformer, said control circuit controlling said ballast inverter to operate said at least one lamp to provide dimmable light output and for independently controlling said filament-heater power supply to operate at an optimum output filament voltage for any light output level.

2. The ballast system of claim 1 wherein said control circuit further comprises a sensing circuit for sensing the absence of an operational lamp in a lamp fixture, said sensing circuit comprising a voltage sensing circuit for sensing voltage across said additional winding and for preventing a starting signal from being generated to a lamp if the voltage across said additional winding is below a threshold value.

3. The ballast system of claim 1 wherein said control circuit further comprises a sensing circuit for sensing the absence of an operational lamp in a lamp fixture, said sensing circuit comprising a current sensing circuit for sensing a current indicative of the presence of lamp filaments and for preventing a starting signal from being generated to a lamp if the current is below a threshold value.

4. The ballast system of claim 3 wherein the sensed current comprises current provided to said filament-heater power supply.

5. The ballast system of claim 1 comprising at least two lamps, said ballast system comprising a separate filament-heater power supply for each respective lamp.

6. The ballast system of claim 5 wherein said filament-heater power supplies have outputs that are diode-ORed together.

7. The ballast system of claim 1 wherein said control circuit further comprises a timing circuit for providing a time delay between providing a voltage to said filaments and energizing said ballast inverter in order to preheat said filaments prior to striking an arc.

8. The ballast system of claim 1 comprising at least two lamps and further comprising a timing circuit for providing a time delay between starting said lamp filaments of said lamps.

9. The ballast system of claim 1 wherein said filament-heater power supply comprises a combination forward and flyback converter.

* * * * *